US007568883B2

(12) United States Patent
Arnold et al.

(10) Patent No.: US 7,568,883 B2
(45) Date of Patent: Aug. 4, 2009

(54) TURBOCHARGER HAVING TWO-STAGE COMPRESSOR WITH BORELESS FIRST-STAGE IMPELLER

(75) Inventors: Steven D. Arnold, Ranch Palos Verdes, CA (US); Gary D. Vrbas, Wilmington, CA (US); Kristian N. Dullack, Carson, CA (US); Glenn F. Thompson, Palos Verdes Estates, CA (US)

(73) Assignee: Honeywell International Inc., Morristown, NJ (US)

( * ) Notice: Subject to any disclaimer, the term of this patent is extended or adjusted under 35 U.S.C. 154(b) by 477 days.

(21) Appl. No.: 11/290,381

(22) Filed: Nov. 30, 2005

(65) Prior Publication Data

US 2007/0122296 A1 May 31, 2007

(51) Int. Cl.
*F04D 29/04* (2006.01)

(52) U.S. Cl. ..... 415/100; 416/199; 416/244 A

(58) Field of Classification Search ..... 415/101, 415/102, 100; 416/199, 244 A, 244 R
See application file for complete search history.

(56) References Cited

U.S. PATENT DOCUMENTS 2,315,656 A * 4/1943 Rhoda ..... 417/81
3,941,506 A * 3/1976 Robb et al. ..... 416/244 A
4,705,463 A 11/1987 Joco
5,176,497 A * 1/1993 Deacon et al. ..... 415/230
5,193,989 A * 3/1993 Fleury et al. ..... 417/407
6,345,503 B1 * 2/2002 Gladden ..... 60/612
6,588,485 B1 * 7/2003 Decker ..... 164/35
6,834,501 B1 * 12/2004 Vrbas et al. ..... 60/612
6,920,754 B2 * 7/2005 Arnold et al. ..... 60/602
2004/0022648 A1 2/2004 Cabrales et al.
2005/0005606 A1 1/2005 Vrbas et al.

FOREIGN PATENT DOCUMENTS

EP 1394387 3/2004
WO PCTISR 3/2007

* cited by examiner

*Primary Examiner*—Edward Look
*Assistant Examiner*—Aaron R Eastman
(74) *Attorney, Agent, or Firm*—Alston & Bird

(57) ABSTRACT

A turbocharger with a two-stage compressor having first- and second-stage impellers mounted on a common shaft in a back-to-back configuration. The first-stage impeller has a boreless configuration, defining an unthreaded pilot hole receiving an unthreaded end of the shaft so as to establish a coaxial relationship between the impeller and the shaft. The first impeller further defines a hollow cylindrical pilot member that projects from the back of the impeller and is received in a portion of the bore through the second-stage impeller to position the impellers coaxially with each other. The shaft passes through the pilot member and is externally threaded for engaging threads on the inner surface of the pilot member to secure the impellers to the shaft. The bore of the second impeller has a second portion that engages an outer cylindrical surface of the shaft to establish a coaxial relationship between the shaft and impeller.

8 Claims, 2 Drawing Sheets

TURBOCHARGER HAVING TWO-STAGE COMPRESSOR WITH BORELESS FIRST-STAGE IMPELLER

BACKGROUND OF THE INVENTION

Figure 1:
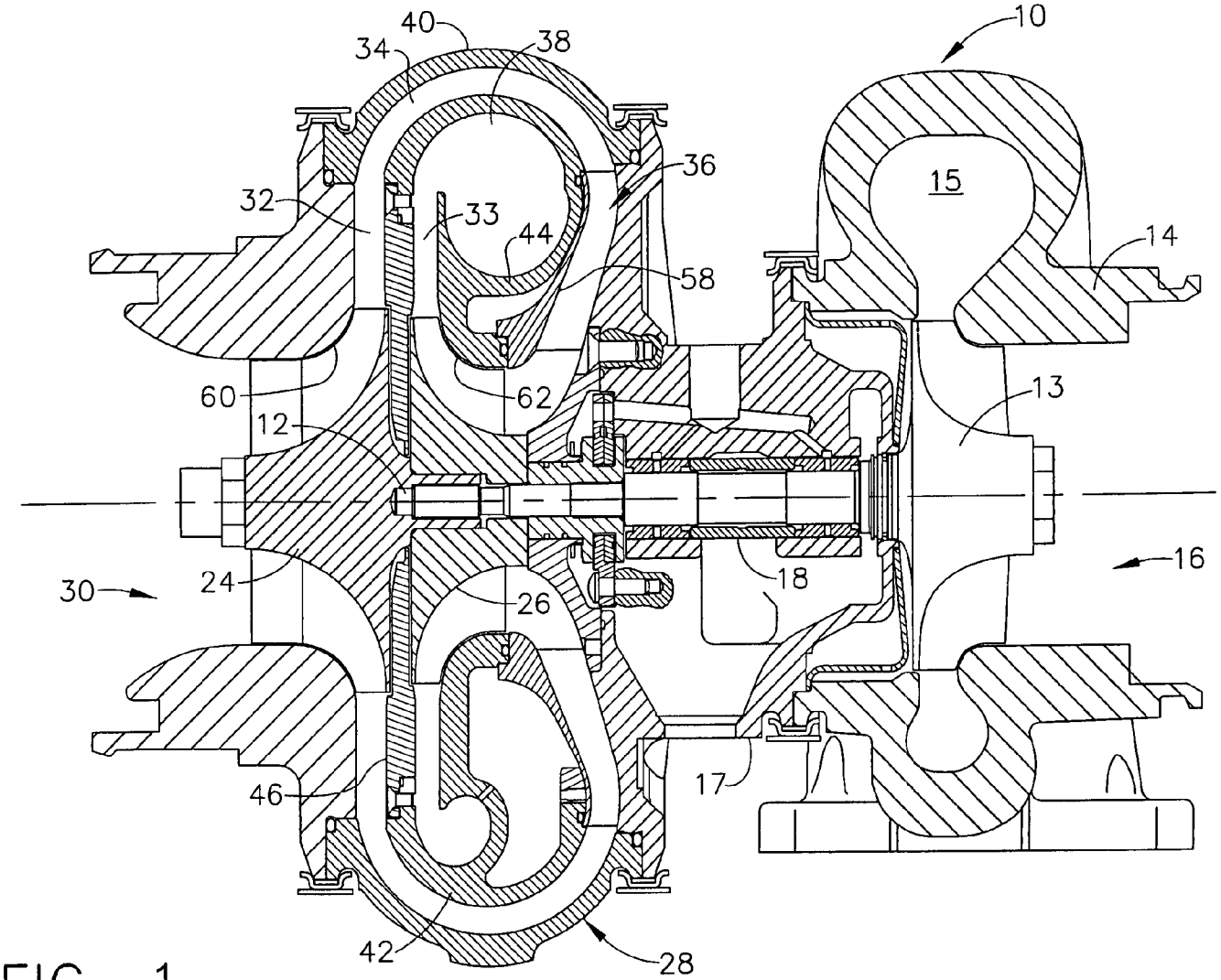

The present invention relates to turbochargers in general, and more particularly relates to high pressure ratio turbochargers employing a two-stage compressor having first- and second-stage impellers arranged in series.

Developments in the turbocharger field continue to require increased pressure ratios for providing improved fuel economy, higher power ratings, and improved emissions performance for engines on which turbochargers are employed, particularly for commercial diesel application. With conventional turbocharger designs, the typical method for achieving such increased pressure ratios has been to increase the rotational speed of the compressor and turbine components. Current pressure-ratio capability for turbochargers of conventional design is typically in the 3.5 range, although some specialized designs can operate at about 4.0. Currently, the only known method for increasing the pressure-ratio capability of a compressor, for a given maximum rotational tip speed, is to reduce the backward curvature of the blades. Backward curvature is used to improve the flow-range capability of a compressor as well as to improve the efficiency, and thus reducing the backward curvature results in less efficiency and a narrower flow range. Requirements for commercial diesel engines for trucking and industrial applications are rapidly approaching pressure ratios of 5 to 6 and possibly higher with flow ranges of over 2.5:1 choke flow to surge flow ratio. Material property limits are exceeded in the rotating components of conventional turbocharger designs at these pressure ratios due to the stresses imposed by the required high rotational speeds. For a turbocharger using a traditional single-stage compressor design, the optimum turbine design for efficiency cannot be used because of the high inertia of a low specific-speed design. High inertia reduces the response of the turbocharger to meet the transient requirements of the engine.

Multiple-stage compression through the use of two or more turbochargers operating with their compressors in series has been an approach to meeting elevated pressure-ratio requirements. However, the cost and complexity of such systems as well as the packaging size requirements are unattractive for most applications.

Turbochargers have been produced having a two-stage compressor in which two impellers are mounted on the same shaft. The compressor housing is configured to route air first through one impeller and then through the other before supplying the air to the engine air intake system. With such two-stage serial compressor designs, pressure ratios of 5 or greater can be achieved at reasonable rotational speeds.

BRIEF SUMMARY OF THE INVENTION

However, because of the high pressure ratio entering the second-stage impeller, it has been found that the temperature of the impeller can be raised to a level that presents significant challenges to the conventional aluminum alloy materials typically used for compressor impellers. Accordingly, it has been necessary to employ a high-temperature material such as titanium for the second-stage impeller. Titanium second-stage impellers can achieve low bore stresses and long service lives. In the development of the present invention, it has been determined that a first-stage impeller made of conventional aluminum material cannot readily match the service life of the titanium second-stage impeller.

The present invention addresses the above needs by providing a "boreless" hub configuration for a two-stage serial compressor and shaft assembly (also referred to herein as a "rotor assembly"), and a turbocharger incorporating such a rotor assembly. In accordance with one embodiment of the invention, a turbocharger comprises a turbine wheel disposed in a turbine housing and mounted on one end of a rotatable shaft for rotation about an axis of the shaft, and a two-stage compressor comprising a compressor wheel mounted on an opposite end of the shaft and disposed within a compressor housing. The compressor wheel comprises a first-stage impeller and a separately formed second-stage impeller, each impeller having a hub and a plurality of compressor blades extending from the hub, wherein the first-stage and second-stage impellers each has a front side and a back, and the impellers are arranged with the back of the first-stage impeller facing generally toward the turbine wheel and toward the back of the second-stage impeller. The hub of the second-stage impeller defines a bore extending entirely through the hub for passage of the shaft therethrough, and the hub of the first-stage impeller defines a pilot hole therein for receiving an end portion of the shaft. The pilot hole, which can be blind, defines an inner cylindrical first pilot surface engaging an outer cylindrical surface of the end portion of the shaft for establishing a coaxial relationship between the first-stage impeller and the shaft.

The hub of the first-stage impeller defines a hollow cylindrical pilot member integrally formed with the first-stage impeller and projecting from the back of the first-stage impeller. The pilot member comprises an inner threaded surface and an outer cylindrical surface coaxial with the first pilot surface of the blind pilot hole. The bore of the second-stage impeller comprises a first bore portion defining an inner cylindrical second pilot surface engaging the outer cylindrical surface of the pilot member for establishing a coaxial relationship between the first- and second-stage impellers.

Additionally, the bore of the second-stage impeller comprises a second bore portion defining an inner cylindrical third pilot surface coaxial with the second pilot surface and engaging an outer cylindrical surface of the shaft for establishing a coaxial relationship between the shaft and the second-stage impeller.

The shaft comprises an externally threaded portion engaging the inner threaded surface of the pilot member for securing the first- and second-stage impellers to the shaft and to each other and constraining relative axial movement therebetween.

Thus, the rotor assembly of the turbocharger defines three piloting features for ensuring the desired mutual concentricity and coaxial relationship between the impellers and between each impeller and the shaft. The first, second, and third pilot surfaces are non-threaded and serve to coaxially locate the impellers and shaft and constrain relative radial movement therebetween without constraining relative axial movement therebetween. Thus, the piloting features are not responsible for the fastening of the impellers to the shaft and to each other. Instead, the threads between the pilot member and the shaft accomplish the attachment function. By separating the attachment and piloting functions, improved concentricity and manufacturability can be achieved.

In one embodiment, the first-stage impeller comprises aluminum and the second-stage impeller comprises titanium.

In accordance with one embodiment of the invention, the back of the first-stage impeller defines an outer annular surface and an inner annular surface located radially inwardly of the outer annular surface, the inner annular surface being axially offset relative to the outer annular surface such that the inner annular surface abuts the back of the second-stage impeller and a space is thereby created between the outer annular surface and the back of the second-stage impeller. An annular seal plate can be disposed in the space defined between the first- and second-stage impellers so that it projects radially outwardly beyond the impellers and engages a portion of the compressor housing. The seal plate divides the first-stage flow path of the compressor from the second-stage flow path.

BRIEF DESCRIPTION OF THE SEVERAL VIEWS OF THE DRAWING(S)

Figure 2:
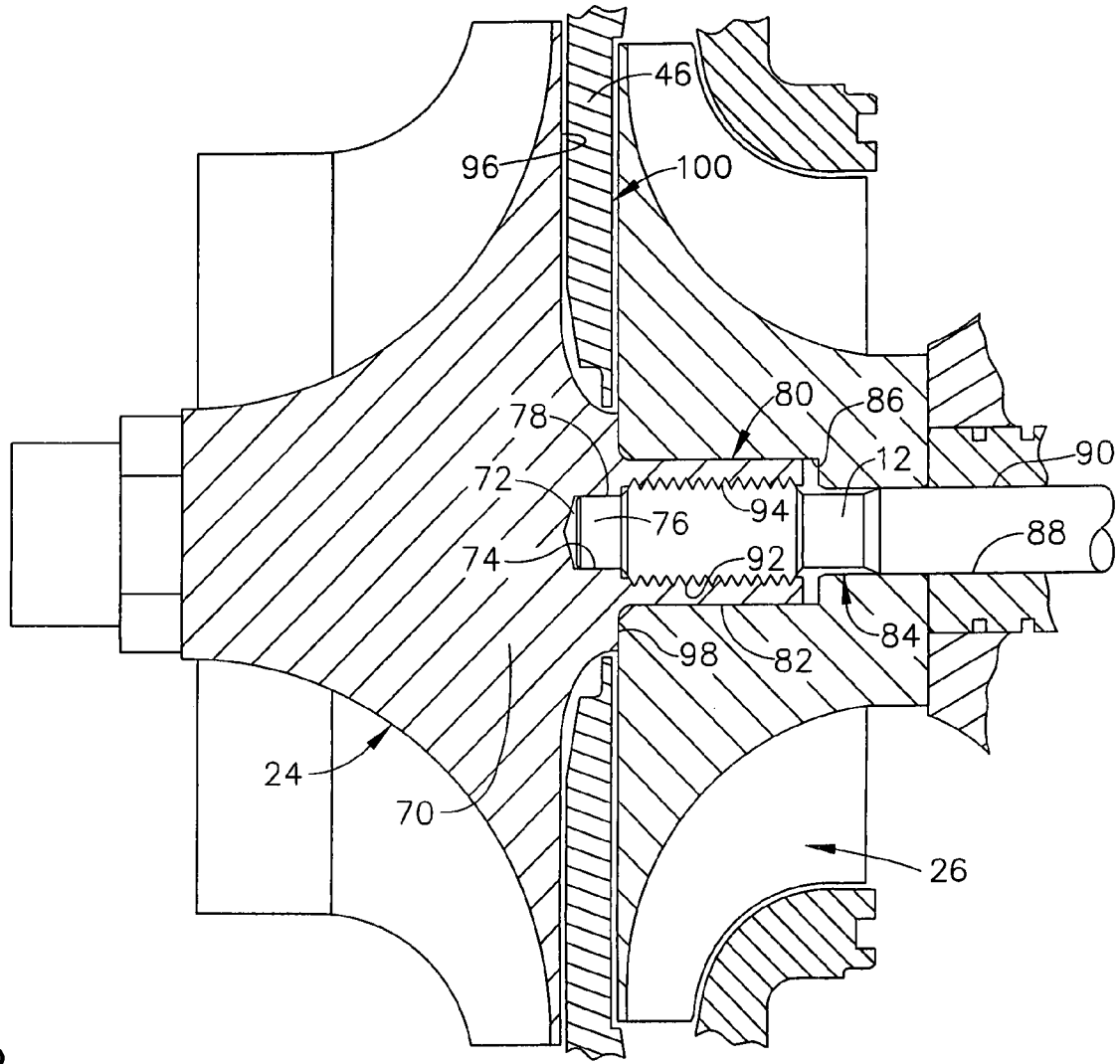

Having thus described the invention in general terms, reference will now be made to the accompanying drawings, which are not necessarily drawn to scale, and wherein:

FIG. 1 is a cross-sectional view of a turbocharger in accordance with one embodiment of the invention; and FIG. 2 is a magnified cross-sectional view of the connection between the impellers and shaft.

DETAILED DESCRIPTION OF THE INVENTION

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 shows a turbocharger 10 having a two-stage compressor in accordance with one embodiment of the invention. The turbocharger 10 has a configuration generally as described in U.S. Pat. No. 6,834,501, the disclosure of which is incorporated herein by reference. The turbocharger 10 includes a rotary shaft 12 on one end of which a turbine wheel 13 is mounted. The turbine section of the turbocharger 10 includes a turbine housing 14 that defines a turbine volute 15 arranged to direct fluid to the turbine wheel. The turbine housing also defines an outlet 16. Exhaust gases from an engine (not shown) are fed into the turbine volute 15. The gases then pass through the turbine and are expanded so that the turbine wheel 13 is rotatably driven, thus rotatably driving the shaft 12. The expanded gases are discharged through the outlet 16. The turbine can be a radial turbine in which the flow enters the turbine in a generally radially inward direction; however, the invention is not limited to any particular turbine arrangement. Furthermore, the turbocharger could include means other than a turbine for driving the shaft 12, such as an electric motor.

The shaft 12 passes through a center housing 17 of the turbocharger. The center housing connects the turbine housing 14 with a compressor housing assembly 28 of the turbocharger as further described below. The center housing contains bearings 18 for the shaft 12. A rear end of the compressor housing assembly 28 is affixed to the center housing 17 in suitable fashion, such as with threaded fasteners or the like.

Mounted on an opposite end of the shaft 12 from the turbine is a two-stage compressor wheel comprising a first-stage impeller 24 and a second-stage impeller 26. Surrounding the compressor wheel is the compressor housing assembly 28. A forward portion of the compressor housing assembly defines a compressor inlet 30 leading into the first-stage impeller 24. As further described below, a rear portion of the compressor housing assembly defines a series of flow paths for leading the pressurized fluid that exits the first-stage impeller into the second-stage impeller and for receiving and discharging the pressurized fluid that exits the second-stage impeller.

More particularly, the rear portion of the compressor housing assembly defines: a first-stage diffuser 32 that receives the fluid discharged from the first-stage impeller and diffuses (i.e., reduces the velocity and hence increases the static pressure of) the fluid; an interstage duct 34 that receives the fluid from the first-stage diffuser 32; an arrangement 36 of deswirl vanes that receive the fluid from the interstage duct and reduce the tangential or "swirl" component of velocity of the fluid, as well as lead the fluid into the second-stage impeller 26; a second-stage diffuser 33 that receives the fluid discharged from the second-stage impeller and diffuses the fluid; and a second-stage volute 38 that receives the fluid from the second-stage diffuser and surrounds the second-stage impeller. Although not visible in FIG. 1, and as further described below, the compressor housing assembly also defines a discharge duct that connects with the second-stage volute 38 and routes the fluid from the volute out of the compressor for feeding to the engine intake manifold or to a charge air cooler before being fed to the engine intake manifold.

The first-stage impeller 24 and second-stage impeller 26 are mounted back-to-back; that is, the downstream side (also referred to as the "back disk") of the first-stage impeller 24 is nearer the turbine than is the upstream side of the impeller, while the downstream side or back disk of the second-stage impeller 26 is farther from the turbine than is the upstream side of the impeller and faces the back disk of the first-stage impeller. The second-stage volute 38 is located generally concentrically within the interstage duct 34. More specifically, the interstage duct 34 is a generally annular structure formed by an outer wall 40 that extends substantially 360 degrees about a central axis of the interstage duct (which axis generally coincides with the axis of the shaft 12, although it does not have to so coincide), and an inner wall 42 that extends substantially 360 degrees about the duct axis and is spaced radially inwardly from the outer wall 40. The interstage duct 34 defined between the inner and outer walls is generally U-shaped in cross-section such that fluid entering the duct is flowing generally radially outwardly (i.e., with little or no axial component, although it does have a substantial swirl component); the duct then turns the fluid so that it is flowing generally axially (again, with substantial swirl component, but with little or no radial component), and finally turns the fluid to a generally radially inward direction (with little or no axial component, but with substantial swirl component) as the fluid enters the deswirl vane arrangement 36. The second-stage volute 38 is located generally concentric with and radially inward of the inner wall 42 of the interstage duct. The volute 38 is delimited at its radially outward side by the inner wall 42, and at its radially inward side by an extension 44 of the wall 42.

The first-stage diffuser 32 is defined between the forward portion of the compressor housing assembly 28 and a stationary seal plate 46. The seal plate separates the diffuser 32 from the second-stage volute 38 and also forms the forward wall of the second-stage diffuser 33. The seal plate engages the compressor wheel with a suitable rotating sealing surface to prevent higher-pressure air discharged from the second-stage impeller from leaking into the lower-pressure first-stage diffuser 32. Other types of seal arrangements can be used instead of the arrangement illustrated in FIG. 1.

The deswirl vane arrangement 36 includes a ring of generally annular form. The vane ring comprises a plurality of deswirl vanes (not shown) that are spaced apart about a circumference of the ring. The vanes are oriented generally radially with respect to the axis of the compressor. The vanes are cambered and arranged in such a way that the leading edges of the vanes (at the outer diameter of the ring) are directed generally in the same direction as the swirling flow entering the vanes from the interstage duct, while the trailing edges (at the inner diameter of the ring) are directed substantially in the direction in which it is desired for the flow to exit the vanes, i.e., with little or no swirl component of velocity. The vanes thus reduce the swirl component of velocity before the flow enters the second-stage impeller.

The vanes are affixed to (and can be integrally formed with) a wall 58 of generally annular form that extends generally radially with respect to the compressor axis. The axial extent of each vane is oriented generally perpendicular to the wall 58. As shown in FIG. 1, a radially inner end of the wall 58 engages the inward extension 44 of the wall of the second-stage volute 38 and an O-ring or the like (not shown) is arranged therebetween for sealing this connection.

The compressor housing includes a first-stage shroud 60 that extends circumferentially about the first-stage impeller 24 closely adjacent to the tips of the blades of the impeller; the main flow path through the first-stage impeller is defined between the first-stage shroud and the hub of the impeller. The housing also includes a second-stage shroud 62, formed by the aforementioned inward extension 44 of the housing wall 42, that extends circumferentially about the second-stage impeller 26 closely adjacent to the tips of the blades of the impeller; the main flow path through the second-stage impeller is defined between the second-stage shroud and the impeller hub.

In accordance with the invention, and as best seen in FIG. 2, the compressor employs a "boreless" joint between the first-stage impeller 24 and the shaft 12, and includes a "triple-piloting" arrangement for establishing a desired coaxial relationship between the two impellers and between each impeller and the shaft. More particularly, with respect to a first piloting feature, the first-stage impeller 24 has a hub 70 defining a pilot hole 72 extending into the back disk of the hub (i.e., the side facing the second-stage impeller 26). The pilot hole 72 can be blind as shown, and defines an inner cylindrical first pilot surface 74 that is coaxial with the first-stage impeller. The pilot hole 72 is unthreaded. An unthreaded end portion 76 of the shaft 12 is received in the pilot hole with a close fit between a cylindrical outer surface 78 of the shaft and the first pilot surface 74 so as to substantially prevent relative radial movement between the shaft and first-stage impeller. The cylindrical outer surface 78 is coaxial with the desired rotational axis of the shaft. Thus, the first piloting feature provided by the engagement of the shaft end portion 76 in the pilot hole 72 establishes a coaxial relationship between the first-stage impeller 24 and the shaft 12.

A second piloting feature establishes a coaxial relationship between the first-stage impeller 24 and the second-stage impeller 26. The first-stage impeller defines a pilot member 80 comprising a hollow cylindrical member. The pilot member 80 is integrally formed with the first-stage impeller and projects from the back disk of the impeller. The pilot member defines an outer cylindrical surface 82 that is coaxial with the first pilot surface 74. The second-stage impeller 26 has a bore 84 extending entirely through the impeller for passage of the shaft 12. The bore 84 has a portion having an inner cylindrical second pilot surface 86 sized to be a close fit with the outer surface 82 of the pilot member 80. The second pilot surface 86 is coaxial with the second-stage impeller. The pilot member is received in the bore and the outer surface 82 engages the second pilot surface 86 to substantially prevent relative radial movement between, and establish a coaxial relationship between, the two impellers 24, 26.

A third piloting feature establishes a coaxial relationship between the second-stage impeller 26 and the shaft 12. The bore 84 in the second-stage impeller 26 has a portion defining an inner cylindrical third pilot surface 88 that is coaxial with the second pilot surface 86. The shaft 12 has a portion defining a cylindrical outer surface 90 that is coaxial with the rotational axis of the shaft and that is a close fit with the third pilot surface 88 so as to substantially prevent relative radial movement between the shaft and second-stage impeller and establish a coaxial relationship therebetween.

The three piloting features noted above establish a coaxial relationship between the first-stage impeller and the shaft, between the first- and second-stage impellers, and between the second-stage impeller and the shaft. However, because the first, second, and third pilot surfaces 74, 86, 88 are unthreaded (as are the corresponding surfaces engaged therewith), the piloting features do not constrain relative axial movement between the impellers and shaft. Axial restraint is provided by a portion of the shaft defining an externally threaded surface 92 located between the end portion 76 and the part of the shaft defining the surface 90. The shaft is received through the hollow pilot member 80. The inner surface 94 of the pilot member is threaded for engaging the externally threaded surface 92 of the shaft so as to secure the first-stage impeller 24 to the shaft and prevent relative axial movement therebetween.

The back disk of the first-stage impeller 24 facing the back disk of the second-stage impeller has an outer annular surface 96 and an inner annular surface 98 located radially inwardly of the outer annular surface. The inner annular surface 98 is axially offset relative to the outer annular surface, and abuts the back disk of the second-stage impeller 26. Accordingly, the outer annular surface 96 is spaced from the opposing surface of the back disk of the second-stage impeller so as to define a space 100 therebetween. The seal plate 46 extends into the space 100 for providing sealing between the first-stage flow path and the second-stage flow path. Fluid pressure loads on the second-stage impeller generally urge the impeller against the inner annular surface 98 of the first-stage impeller.

The rotor assembly (comprising the impellers 24, 26, the shaft 12, and the turbine wheel 13) is assembled into the turbocharger 10 by first affixing the turbine wheel to the shaft by a suitable process such as welding or brazing. The impellers 24, 26 and seal plate 46 are pre-assembled by inserting the pilot member 80 of the first-stage impeller 24 into the bore 84 of the second-stage impeller 26 to capture the seal plate between the impellers, and this assembly is assembled into the compressor housing 28 by fastening the seal plate 46 to the housing. The compressor housing is then bolted to the center housing 17. The shaft 12 next is inserted (right-to-left in FIG. 1) through the bearings 18 in the center housing 17 and through the bore 84 of the second-stage impeller 26 until the externally threaded surface 92 of the shaft engages the internally threaded surface 94 of the pilot member 80 of the first-stage impeller. The shaft is rotated relative to the first-stage impeller to screw these parts together. The turbine housing 14 can then be bolted to the center housing 17.

The boreless design of the joint between the first-stage impeller 24 and the shaft 12 allows the first-stage impeller to be manufactured from an aluminum alloy material while achieving a service life comparable to that of the second-stage impeller 26 constructed from a high-temperature material such as titanium alloy.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbocharger, comprising:

a turbine wheel disposed in a turbine housing and mounted on one end of a rotatable shaft for rotation about an axis of the shaft, an opposite end of the shaft defining an unthreaded end portion and an externally threaded portion spaced in a first axial direction from the unthreaded end portion;

a two-stage compressor comprising a compressor wheel mounted on an opposite end of the shaft and disposed within a compressor housing, the compressor wheel comprising a first-stage impeller and a separately formed second-stage impeller, each impeller having a hub and a plurality of compressor blades extending from the hub, wherein the first-stage and second-stage impellers each has a front side and a back, and the impellers are arranged with the back of the first-stage impeller facing in the first axial direction generally toward the turbine wheel and toward the back of the second-stage impeller;

the hub of the second-stage impeller defining a bore extending entirely through the hub for passage of the shaft therethrough, the hub of the first-stage impeller defining an unthreaded pilot hole for receiving the unthreaded end portion of the shaft, the pilot hole defining an inner cylindrical first pilot surface engaging an outer cylindrical surface of the unthreaded end portion of the shaft for establishing a coaxial relationship between the first-stage impeller and the shaft;

the hub of the first-stage impeller defining a hollow cylindrical pilot member integrally formed with the first-stage impeller and projecting from the back of the first-stage impeller, the pilot member comprising an inner threaded surface spaced in the first axial direction from the first pilot surface, and an outer cylindrical surface coaxial with the first pilot surface of the pilot hole;

the bore of the second-stage impeller comprising a first bore portion defining an inner cylindrical second pilot surface engaging the outer cylindrical surface of the pilot member for establishing a coaxial relationship between the first- and second-stage impellers, and a second bore portion defining an inner cylindrical third pilot surface coaxial with the second pilot surface and engaging an outer cylindrical surface of the shaft for establishing a coaxial relationship between the shaft and the second-stage impeller; and the externally threaded portion of the shaft engaging the inner threaded surface of the pilot member for securing the first- and second-stage impellers to the shaft and to each other and constraining relative axial movement therebetween, wherein the first, second, and third pilot surfaces are non-threaded and serve to coaxially locate the impellers and shaft and constrain relative radial movement therebetween without constraining relative axial movement therebetween.

2. The turbocharger of claim 1, wherein the first-stage impeller comprises aluminum and the second-stage impeller comprises titanium.

3. The turbocharger of claim 1, wherein the back of the first-stage impeller defines an outer annular surface and an inner annular surface located radially inwardly of the outer annular surface, the inner annular surface being axially offset relative to the outer annular surface such that the inner annular surface abuts the back of the second-stage impeller and a space is thereby created between the outer annular surface and the back of the second-stage impeller.

4. The turbocharger of claim 3, further comprising an annular seal plate disposed in the space defined between the first- and second-stage impellers and projecting radially outwardly beyond the impellers and engaging a portion of the compressor housing.

5. A rotor assembly for a turbocharger, comprising:

a shaft rotatable about an axis of the shaft, the shaft defining an unthreaded end portion spaced in a first axial direction from an externally threaded portion of the shaft;

a compressor wheel mounted on the shaft, the compressor wheel comprising a first-stage impeller and a separately formed second-stage impeller, each impeller having a hub and a plurality of compressor blades extending from the hub, wherein the first-stage and second-stage impellers each has a front side and a back, and the impellers are arranged with the back of the first-stage impeller facing in the first axial direction toward the back of the second-stage impeller;

the hub of the second-stage impeller defining a bore extending entirely through the hub for passage of the shaft therethrough, the hub of the first-stage impeller defining an unthreaded pilot hole for receiving the unthreaded end portion of the shaft, the pilot hole defining an inner cylindrical first pilot surface engaging an outer cylindrical surface of the unthreaded end portion of the shaft for establishing a coaxial relationship between the first-stage impeller and the shaft;

the hub of the first-stage impeller defining a hollow cylindrical pilot member integrally formed with the first-stage impeller and projecting from the back of the first-stage impeller, the pilot member comprising an inner threaded surface spaced in the first axial direction from the first pilot surface, and an outer cylindrical surface coaxial with the first pilot surface of the pilot hole;

the bore of the second-stage impeller comprising a first bore portion defining an inner cylindrical second pilot surface engaging the outer cylindrical surface of the pilot member for establishing a coaxial relationship between the first- and second-stage impellers, and a second bore portion defining an inner cylindrical third pilot surface coaxial with the second pilot surface and engaging an outer cylindrical surface of the shaft for establishing a coaxial relationship between the shaft and the second-stage impeller; and the externally threaded portion of the shaft engaging the inner threaded surface of the pilot member for securing the first- and second-stage impellers to the shaft and to each other and constraining relative axial movement therebetween, wherein the first, second, and third pilot surfaces are non-threaded and serve to coaxially locate the impellers and shaft and constrain relative radial movement therebetween without constraining relative axial movement therebetween.

6. The rotor assembly of claim 5, wherein the first-stage impeller comprises aluminum and the second-stage impeller comprises titanium.

7. The rotor assembly of claim 5, wherein the back of the first-stage impeller defines an outer annular surface and an inner annular surface located radially inwardly of the outer annular surface, the inner annular surface being axially offset relative to the outer annular surface such that the inner annular surface abuts the back of the second-stage impeller and a space is thereby created between the outer annular surface and the back of the second-stage impeller.

8. The rotor assembly of claim 5, further comprising a turbine wheel mounted on an opposite end of the shaft from the compressor wheel.

* * * * *